US009801786B2

(12) United States Patent
Lev et al.

(10) Patent No.: US 9,801,786 B2
(45) Date of Patent: Oct. 31, 2017

(54) DRUG CONTAINER CLOSURE FOR MOUNTING ON OPEN-TOPPED DRUG CONTAINER TO FORM DRUG RECONSTITUTION ASSEMBLAGE FOR USE WITH NEEDLELESS SYRINGE

(71) Applicant: MEDIMOP Medical Projects Ltd., Ra'anana (IL)

(72) Inventors: Nimrod Lev, Savion (IL); Mordechai Bukhman, Netanya (IL)

(73) Assignee: Medimop Medical Projects Ltd., Ra'anana (IL)

( * ) Notice: Subject to any disclaimer, the term of this patent is extended or adjusted under 35 U.S.C. 154(b) by 188 days.

(21) Appl. No.: 14/784,300

(22) PCT Filed: Apr. 3, 2014

(86) PCT No.: PCT/IL2014/050327
§ 371 (c)(1),
(2) Date: Oct. 14, 2015

(87) PCT Pub. No.: WO2014/170888
PCT Pub. Date: Oct. 23, 2014

(65) Prior Publication Data

US 2016/0051446 A1 Feb. 25, 2016

(30) Foreign Application Priority Data

Apr. 14, 2013 (IL) ..... 225734

(51) Int. Cl.

| | |
|---|---|
| ***A61J 1/20*** | (2006.01) |
| *A61J 1/10* | (2006.01) |
| *A61J 1/14* | (2006.01) |

(52) U.S. Cl.
CPC ..... *A61J 1/2089* (2013.01); *A61J 1/2051* (2015.05); *A61J 1/2055* (2015.05); *A61J 1/2096* (2013.01);
(Continued)

(58) Field of Classification Search
CPC ..... A61J 1/2089; A61J 1/2051; A61J 1/2055; A61J 1/2096; A61J 1/201; A61J 1/2065; A61J 1/10; A61J 1/1406
(Continued)

(56) References Cited

U.S. PATENT DOCUMENTS

| | | | |
|---|---|---|---|
| 62,333 | A | 2/1867 | Holl |
| 247,975 | A | 10/1881 | Wickes |

(Continued)

FOREIGN PATENT DOCUMENTS

| | | | |
|---|---|---|---|
| CN | 1950049 | A | 4/2007 |
| DE | 1913926 | A1 | 9/1970 |

(Continued)

OTHER PUBLICATIONS

Grifols Vial Adapter Product Literature, 2 pages, Jan. 2002.

(Continued)

*Primary Examiner* — Andrew Perreault
(74) *Attorney, Agent, or Firm* — Panitch Schwarze Belisario & Nadel LLP

(57) ABSTRACT

A drug container closure for mounting on an open-topped drug container to form a ready-to-use drug reconstitution assemblage for use with a needleless syringe. The drug container closure includes a drug container stopper for sealing the drug container and a fluid transfer member with an integral needleless syringe connector and a puncturing cannula. The fluid transfer member is manually disposed along a diametric inverted L-shaped track pair from an initial non-puncturing position to a puncturing position. The (Continued)

inverted L-shaped track pair includes one-way snap members to prevent a user returning the fluid transfer member to an earlier position and indicating progress of the user activation.

6 Claims, 10 Drawing Sheets

(52) U.S. Cl.
CPC ..... *A61J 1/10* (2013.01); *A61J 1/1406* (2013.01); *A61J 1/201* (2015.05); *A61J 1/2065* (2015.05)

(58) Field of Classification Search
USPC ..... 220/277; 604/415, 414
See application file for complete search history.

(56) References Cited

U.S. PATENT DOCUMENTS 254,444 A 2/1882 Vogel
300,060 A 6/1884 Ford
1,021,681 A 3/1912 Jennings
1,704,817 A 3/1929 Ayers
1,930,944 A 10/1933 Schmitz, Jr.
2,326,490 A 8/1943 Perelson
2,560,162 A 7/1951 Garwood
2,748,769 A 6/1956 Huber
2,830,587 A 4/1958 Everett
2,931,668 A 4/1960 Baley
2,968,497 A 1/1961 Treleman
3,059,643 A 10/1962 Barton
D198,499 S 6/1964 Harautuneian
3,225,763 A 12/1965 Waterman
3,277,893 A 10/1966 Clark
3,308,822 A 3/1967 De Luca
3,484,849 A 12/1969 Huebner et al.
3,618,637 A 11/1971 Santomieri
3,757,981 A 9/1973 Harris, Sr. et al.
3,788,524 A 1/1974 Davis et al.
3,822,700 A 7/1974 Pennington
3,826,261 A 7/1974 Killinger
3,872,992 A 3/1975 Larson
3,885,607 A 5/1975 Peltier
3,938,520 A 2/1976 Scislowicz et al.
3,957,052 A 5/1976 Topham
3,977,555 A 8/1976 Larson
3,993,063 A 11/1976 Larrabee
4,020,839 A 5/1977 Klapp
4,051,852 A 10/1977 Villari
D247,975 S 5/1978 Luther
D248,568 S 7/1978 Ismach
4,109,670 A 8/1978 Slagel
4,121,585 A 10/1978 Becker, Jr.
4,161,178 A 7/1979 Genese
4,187,848 A 2/1980 Taylor
D254,444 S 3/1980 Levine
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley et al.
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
D270,282 S 8/1983 Gross
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustavsson
4,573,993 A 3/1986 Hoag et al.
4,576,211 A 3/1986 Valentini et al.
4,581,014 A 4/1986 Millerd et al.
4,585,446 A 4/1986 Kempf
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,675,020 A 6/1987 McPhee
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
D300,060 S 2/1989 Molgaard-Nielsen
4,804,366 A 2/1989 Zdeb et al.
4,826,492 A 5/1989 Magasi
4,832,690 A 5/1989 Kuu
4,834,152 A 5/1989 Howson et al.
D303,013 S 8/1989 Konopka
4,857,062 A 8/1989 Russell
4,865,592 A 9/1989 Rycroft
4,871,463 A 10/1989 Taylor et al.
4,898,209 A 2/1990 Zbed
4,909,290 A 3/1990 Coccia
4,927,423 A 5/1990 Malmborg
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van der Heiden et al.
5,006,114 A 4/1991 Rogers et al.
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco
5,088,996 A 2/1992 Kopfer et al.
5,096,575 A 3/1992 Cosack
5,104,387 A 4/1992 Pokorney et al.
5,113,904 A 5/1992 Aslanian
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.

(56) References Cited

U.S. PATENT DOCUMENTS 5,232,109 A 8/1993 Tirrell et al.
5,242,432 A 9/1993 DeFrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,304,165 A 4/1994 Haber et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,348,548 A 9/1994 Meyer et al.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
D357,733 S 4/1995 Matkovich
5,429,614 A 7/1995 Fowles et al.
5,433,330 A 7/1995 Yatsko et al.
5,445,630 A 8/1995 Richmond
5,445,631 A 8/1995 Uchida
D362,718 S 9/1995 Deily et al.
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,472,022 A 12/1995 Michel et al.
5,478,337 A 12/1995 Okamoto et al.
5,492,147 A 2/1996 Challender et al.
D369,406 S 4/1996 Niedospial et al.
5,505,714 A 4/1996 Dassa et al.
5,509,433 A 4/1996 Paradis
5,515,871 A 5/1996 Bittner et al.
5,520,659 A 5/1996 Hedges
5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,562,696 A 10/1996 Nobles et al.
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,637,101 A 6/1997 Shillington
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,674,195 A 10/1997 Truthan
5,676,346 A 10/1997 Leinsing
5,685,845 A 11/1997 Grimard
D388,172 S 12/1997 Cipes
5,699,821 A 12/1997 Paradis
5,702,019 A 12/1997 Grimard
5,718,346 A 2/1998 Weiler
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,752,942 A 5/1998 Doyle et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,810,792 A 9/1998 Fangrow, Jr. et al.
D399,559 S 10/1998 Molina
5,817,082 A 10/1998 Niedospial, Jr. et al.
5,820,621 A 10/1998 Yale et al.
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
D405,522 S 2/1999 Hoenig et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
D410,740 S 6/1999 Molina
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,944,700 A 8/1999 Nguyen et al.
5,954,104 A 9/1999 Daubert et al.
5,968,022 A 10/1999 Saito
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
D427,309 S 6/2000 Molina
6,070,623 A 6/2000 Aneas
6,071,270 A 6/2000 Fowles et al.
6,080,132 A 6/2000 Cole et al.
D428,141 S 7/2000 Brotspies et al.
6,086,762 A 7/2000 Guala
6,089,541 A 7/2000 Weinheimer et al.
6,090,091 A 7/2000 Fowles et al.
6,090,093 A 7/2000 Thibault et al.
6,092,692 A 7/2000 Riskin
D430,291 S 8/2000 Jansen et al.
6,099,511 A 8/2000 Devos et al.
6,113,068 A 9/2000 Ryan

(56) References Cited

U.S. PATENT DOCUMENTS 6,113,583 A 9/2000 Fowles et al.
6,117,114 A 9/2000 Paradis
D431,864 S 10/2000 Jansen
6,139,534 A 10/2000 Niedospial, Jr. et al.
6,142,446 A 11/2000 Leinsing
6,146,362 A 11/2000 Turnbull et al.
6,149,623 A 11/2000 Reynolds
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,173,868 B1 1/2001 DeJonge
6,174,304 B1 1/2001 Weston
6,179,822 B1 1/2001 Niedospial, Jr.
6,179,823 B1 1/2001 Niedospial, Jr.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
D457,954 S 5/2002 Wallace et al.
6,382,442 B1 5/2002 Thibault et al.
6,386,397 B2 5/2002 Brotspies et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.
D476,731 S 7/2003 Cise et al.
6,591,876 B2 7/2003 Safabash
6,599,273 B1 7/2003 Lopez
6,601,721 B2 8/2003 Jansen et al.
6,626,309 B1 9/2003 Jansen et al.
6,638,244 B1 10/2003 Reynolds
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Arnissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,884,253 B1 4/2005 McFarlane
6,890,328 B2 5/2005 Fowles et al.
D506,256 S 6/2005 Miyoshi et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,951,613 B2 10/2005 Reif et al.
6,957,745 B2 10/2005 Thibault et al.
6,960,164 B2 11/2005 O'Heeron
6,979,318 B1 12/2005 McDonald et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,100,890 B2 9/2006 Cote, Sr. et al.
7,140,401 B2 11/2006 Wilcox et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
D580,558 S 11/2008 Shigesada et al.
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.

(56) References Cited

U.S. PATENT DOCUMENTS

| | | | |
|---|---|---|---|
| 7,544,191 | B2 | 6/2009 | Peluso et al. |
| D595,862 | S | 7/2009 | Suzuki et al. |
| D595,863 | S | 7/2009 | Suzuki et al. |
| 7,611,487 | B2 | 11/2009 | Woehr et al. |
| 7,611,502 | B2 | 11/2009 | Daly |
| 7,615,041 | B2 | 11/2009 | Sullivan et al. |
| 7,628,779 | B2 | 12/2009 | Aneas |
| 7,632,261 | B2 | 12/2009 | Zinger et al. |
| D608,900 | S | 1/2010 | Giraud et al. |
| 7,654,995 | B2 | 2/2010 | Warren et al. |
| 7,670,326 | B2 | 3/2010 | Shemesh |
| 7,695,445 | B2 | 4/2010 | Yuki |
| D616,090 | S | 5/2010 | Kawamura |
| 7,713,247 | B2 | 5/2010 | Lopez |
| 7,717,886 | B2 | 5/2010 | Lopez |
| 7,722,090 | B2 | 5/2010 | Burton et al. |
| D616,984 | S | 6/2010 | Gilboa |
| 7,731,678 | B2 | 6/2010 | Tennican et al. |
| 7,743,799 | B2 | 6/2010 | Mosler et al. |
| 7,744,581 | B2 | 6/2010 | Wallen et al. |
| 7,757,901 | B2 | 7/2010 | Welp |
| 7,758,082 | B2 | 7/2010 | Weigel et al. |
| 7,758,560 | B2 | 7/2010 | Connell et al. |
| 7,762,524 | B2 | 7/2010 | Cawthon et al. |
| 7,766,304 | B2 | 8/2010 | Phillips |
| 7,771,383 | B2 | 8/2010 | Truitt et al. |
| D624,641 | S | 9/2010 | Boclet |
| 7,799,009 | B2 | 9/2010 | Niedospial, Jr. et al. |
| 7,803,140 | B2 | 9/2010 | Fangrow, Jr. |
| D627,216 | S | 11/2010 | Fulginiti |
| D630,732 | S | 1/2011 | Lev et al. |
| 7,862,537 | B2 | 1/2011 | Zinger et al. |
| 7,867,215 | B2 | 1/2011 | Akerlund et al. |
| 7,879,018 | B2 | 2/2011 | Zinger et al. |
| 7,895,216 | B2 | 2/2011 | Longshaw et al. |
| D634,007 | S | 3/2011 | Zinger et al. |
| 7,900,659 | B2 | 3/2011 | Whitley et al. |
| D637,713 | S | 5/2011 | Nord et al. |
| D641,080 | S | 7/2011 | Zinger et al. |
| 7,985,216 | B2 | 7/2011 | Daily et al. |
| D644,104 | S | 8/2011 | Maeda et al. |
| 7,993,328 | B2 | 8/2011 | Whitley |
| 8,007,461 | B2 | 8/2011 | Huo et al. |
| 8,012,132 | B2 | 9/2011 | Lum et al. |
| 8,016,809 | B2 | 9/2011 | Zinger et al. |
| 8,021,325 | B2 | 9/2011 | Zinger et al. |
| 8,025,653 | B2 | 9/2011 | Capitaine et al. |
| 8,029,472 | B2 | 10/2011 | Leinsing et al. |
| 8,038,123 | B2 | 10/2011 | Ruschke et al. |
| 8,066,688 | B2 | 11/2011 | Zinger et al. |
| 8,070,739 | B2 | 12/2011 | Zinger et al. |
| 8,075,550 | B2 | 12/2011 | Nord et al. |
| 8,096,525 | B2 | 1/2012 | Ryan |
| 8,105,314 | B2 | 1/2012 | Fangrow, Jr. |
| D654,166 | S | 2/2012 | Lair |
| D655,017 | S | 2/2012 | Mosler et al. |
| 8,122,923 | B2 | 2/2012 | Kraus et al. |
| 8,123,736 | B2 | 2/2012 | Kraushaar et al. |
| D657,461 | S | 4/2012 | Schembre et al. |
| 8,157,784 | B2 | 4/2012 | Rogers |
| 8,167,863 | B2 | 5/2012 | Yow |
| 8,172,824 | B2 | 5/2012 | Pfeifer et al. |
| 8,177,768 | B2 | 5/2012 | Leinsing |
| 8,182,452 | B2 | 5/2012 | Mansour et al. |
| 8,187,248 | B2 | 5/2012 | Zihlmann |
| 8,196,614 | B2 | 6/2012 | Kriheli |
| 8,197,459 | B2 | 6/2012 | Jansen et al. |
| 8,211,069 | B2 | 7/2012 | Fangrow, Jr. |
| 8,225,959 | B2 | 7/2012 | Lambrecht |
| 8,241,268 | B2 | 8/2012 | Whitley |
| 8,262,628 | B2 | 9/2012 | Fangrow, Jr. |
| 8,262,641 | B2 | 9/2012 | Vedrine et al. |
| 8,267,127 | B2 | 9/2012 | Kriheli |
| D669,980 | S | 10/2012 | Lev et al. |
| 8,287,513 | B2 | 10/2012 | Ellstrom et al. |
| D673,673 | S | 1/2013 | Wang |
| D674,084 | S | 1/2013 | Linnenschmidt |
| D674,088 | S | 1/2013 | Lev et al. |
| D681,230 | S | 4/2013 | Mosler et al. |
| 8,454,573 | B2 | 6/2013 | Wyatt et al. |
| 8,469,939 | B2 | 6/2013 | Fangrow, Jr. |
| 8,475,404 | B2 | 7/2013 | Foshee et al. |
| 8,480,645 | B1 | 7/2013 | Choudhury et al. |
| 8,480,646 | B2 | 7/2013 | Nord et al. |
| 8,506,548 | B2 | 8/2013 | Okiyama |
| 8,511,352 | B2 | 8/2013 | Kraus et al. |
| 8,512,309 | B2 | 8/2013 | Shemesh et al. |
| D690,009 | S | 9/2013 | Schembre et al. |
| D690,418 | S | 9/2013 | Rosenquist |
| 8,523,837 | B2 | 9/2013 | Wiggins et al. |
| 8,545,476 | B2 | 10/2013 | Ariagno et al. |
| 8,551,067 | B2 | 10/2013 | Zinger et al. |
| 8,556,879 | B2 | 10/2013 | Okiyama |
| 8,562,582 | B2 | 10/2013 | Tuckwell et al. |
| 8,608,723 | B2 | 12/2013 | Lev et al. |
| 8,628,508 | B2 | 1/2014 | Weitzel et al. |
| 8,684,992 | B2 | 4/2014 | Sullivan et al. |
| 8,752,598 | B2 | 6/2014 | Denenburg et al. |
| D714,935 | S | 10/2014 | Nishioka et al. |
| D717,406 | S | 11/2014 | Stanley et al. |
| D717,948 | S | 11/2014 | Strong et al. |
| D719,650 | S | 12/2014 | Arinobe et al. |
| D720,067 | S | 12/2014 | Rosenquist |
| D720,451 | S | 12/2014 | Denenburg et al. |
| D720,452 | S | 12/2014 | Jordan |
| 8,900,212 | B2 | 12/2014 | Kubo |
| D720,850 | S | 1/2015 | Hsia et al. |
| D732,660 | S | 6/2015 | Ohashi |
| D732,664 | S | 6/2015 | Woehr et al. |
| D733,291 | S | 6/2015 | Wang |
| D733,292 | S | 6/2015 | Rogers |
| D733,293 | S | 6/2015 | Rogers |
| D738,494 | S | 9/2015 | Kashmirian |
| D741,457 | S | 10/2015 | Guest |
| D750,235 | S | 2/2016 | Maurice |
| 2001/0000347 | A1 | 4/2001 | Hellstrom et al. |
| 2001/0025671 | A1 | 10/2001 | Safabash |
| 2001/0029360 | A1 | 10/2001 | Miyoshi et al. |
| 2001/0051793 | A1 | 12/2001 | Weston |
| 2002/0017328 | A1 | 2/2002 | Loo |
| 2002/0066715 | A1 | 6/2002 | Niedospial |
| 2002/0087118 | A1 | 7/2002 | Reynolds et al. |
| 2002/0087141 | A1 | 7/2002 | Zinger et al. |
| 2002/0087144 | A1 | 7/2002 | Zinger et al. |
| 2002/0121496 | A1 | 9/2002 | Thiebault et al. |
| 2002/0123736 | A1 | 9/2002 | Fowles et al. |
| 2002/0127150 | A1 | 9/2002 | Sasso |
| 2002/0128628 | A1 | 9/2002 | Fathallah |
| 2002/0138045 | A1 | 9/2002 | Moen |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0069550 | A1 | 4/2003 | Sharp |
| 2003/0073971 | A1 | 4/2003 | Saker |
| 2003/0100866 | A1 | 5/2003 | Reynolds |
| 2003/0109846 | A1 | 6/2003 | Zinger et al. |
| 2003/0120209 | A1 | 6/2003 | Jensen et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199846 | A1 | 10/2003 | Fowles et al. |
| 2003/0199847 | A1 | 10/2003 | Akerlund et al. |
| 2003/0205843 | A1 | 11/2003 | Adams |
| 2003/0236543 | A1 | 12/2003 | Brenneman et al. |
| 2004/0024354 | A1 | 2/2004 | Reynolds |
| 2004/0039365 | A1 | 2/2004 | Aramata et al. |
| 2004/0044327 | A1 | 3/2004 | Hasegawa |
| 2004/0073189 | A1 | 4/2004 | Wyatt et al. |
| 2004/0143218 | A1 | 7/2004 | Das |
| 2004/0143226 | A1 | 7/2004 | Marsden |
| 2004/0153047 | A1 | 8/2004 | Blank et al. |

(56) References Cited

U.S. PATENT DOCUMENTS

2004/0167472 A1 8/2004 Howell et al.
2004/0181192 A1 9/2004 Cuppy
2004/0204699 A1 10/2004 Hanly et al.
2004/0217315 A1 11/2004 Doyle
2004/0225274 A1 11/2004 Jansen et al.
2004/0236305 A1 11/2004 Jansen et al.
2004/0255952 A1 12/2004 Carlsen et al.
2005/0015070 A1 1/2005 Delnevo et al.
2005/0016626 A1 1/2005 Wilcox et al.
2005/0055008 A1 3/2005 Paradis et al.
2005/0082828 A1 4/2005 Wicks et al.
2005/0124964 A1 6/2005 Niedospial et al.
2005/0137523 A1 6/2005 Wyatt et al.
2005/0137566 A1 6/2005 Fowles et al.
2005/0148994 A1 7/2005 Leinsing
2005/0159724 A1 7/2005 Enerson
2005/0182383 A1 8/2005 Wallen
2005/0209554 A1 9/2005 Landau
2005/0261637 A1 11/2005 Miller
2005/0277896 A1 12/2005 Messerli et al.
2006/0030832 A1 2/2006 Niedospial et al.
2006/0079834 A1 4/2006 Tennican et al.
2006/0089594 A1 4/2006 Landau
2006/0089603 A1 4/2006 Truitt et al.
2006/0095015 A1 5/2006 Hobbs et al.
2006/0106360 A1 5/2006 Wong
2006/0135948 A1 6/2006 Varma
2006/0155257 A1 7/2006 Reynolds
2006/0161192 A1 7/2006 Young
2006/0178646 A1 8/2006 Harris et al.
2006/0212004 A1 9/2006 Atil
2006/0253084 A1 11/2006 Nordgren
2006/0259004 A1 11/2006 Connell et al.
2007/0024995 A1 2/2007 Hayashi
2007/0060904 A1 3/2007 Vedrine et al.
2007/0078428 A1 4/2007 Reynolds et al.
2007/0079894 A1 4/2007 Kraus et al.
2007/0083164 A1 4/2007 Barrelle et al.
2007/0088252 A1 4/2007 Pestotnik et al.
2007/0088293 A1 4/2007 Fangrow
2007/0088313 A1 4/2007 Zinger et al.
2007/0106244 A1 5/2007 Mosler et al.
2007/0112324 A1 5/2007 Hamedi-Sangsari
2007/0156112 A1 7/2007 Walsh
2007/0167904 A1 7/2007 Zinger et al.
2007/0191760 A1 8/2007 Iguchi et al.
2007/0191764 A1 8/2007 Zihlmann
2007/0191767 A1 8/2007 Hennessy et al.
2007/0203451 A1 8/2007 Murakami et al.
2007/0219483 A1 9/2007 Kitani et al.
2007/0244447 A1 10/2007 Capitaine et al.
2007/0244461 A1 10/2007 Fangrow
2007/0244462 A1 10/2007 Fangrow
2007/0244463 A1 10/2007 Warren et al.
2007/0249995 A1 10/2007 Van Manen
2007/0255202 A1 11/2007 Kitani et al.
2007/0265574 A1 11/2007 Tennican et al.
2007/0265581 A1 11/2007 Funamura et al.
2007/0270778 A9 11/2007 Zinger et al.
2007/0287953 A1 12/2007 Ziv et al.
2007/0299404 A1 12/2007 Katoh et al.
2008/0009789 A1 1/2008 Zinger et al.
2008/0009822 A1 1/2008 Enerson
2008/0015496 A1 1/2008 Hamedi-Sangsari
2008/0135051 A1 6/2008 Lee
2008/0172024 A1 7/2008 Yow
2008/0188799 A1 8/2008 Mueller-Beckhaus et al.
2008/0249479 A1 10/2008 Zinger et al.
2008/0249498 A1 10/2008 Fangrow
2008/0262465 A1 10/2008 Zinger et al.
2008/0287905 A1 11/2008 Hiejima et al.
2008/0294100 A1 11/2008 de Costa et al.
2008/0306439 A1 12/2008 Nelson et al.
2008/0312634 A1 12/2008 Helmerson et al.
2009/0012492 A1 1/2009 Zihlmann
2009/0082750 A1 3/2009 Denenburg et al.
2009/0143758 A1 6/2009 Okiyama
2009/0177177 A1 7/2009 Zinger et al.
2009/0177178 A1 7/2009 Pedersen
2009/0187140 A1 7/2009 Racz
2009/0216212 A1 8/2009 Fangrow, Jr.
2009/0267011 A1 10/2009 Hatton et al.
2009/0299325 A1 12/2009 Vedrine et al.
2009/0318946 A1 12/2009 Tamesada
2009/0326506 A1 12/2009 Hasegawa et al.
2010/0010443 A1 1/2010 Morgan et al.
2010/0016811 A1 1/2010 Smith
2010/0022985 A1 1/2010 Sullivan et al.
2010/0030181 A1 2/2010 Helle et al.
2010/0036319 A1 2/2010 Drake et al.
2010/0076397 A1 3/2010 Reed et al.
2010/0087786 A1 4/2010 Zinger et al.
2010/0137827 A1 6/2010 Warren et al.
2010/0160889 A1 6/2010 Smith et al.
2010/0168664 A1 7/2010 Zinger et al.
2010/0168712 A1 7/2010 Tuckwell et al.
2010/0179506 A1 7/2010 Shemesh et al.
2010/0198148 A1 8/2010 Zinger et al.
2010/0204670 A1 8/2010 Kraushaar et al.
2010/0241088 A1 9/2010 Ranalletta et al.
2010/0274184 A1 10/2010 Chun
2010/0286661 A1 11/2010 Raday et al.
2010/0312220 A1 12/2010 Kalitzki
2011/0004143 A1 1/2011 Beiriger et al.
2011/0004184 A1 1/2011 Proksch et al.
2011/0044850 A1 2/2011 Solomon et al.
2011/0054440 A1 3/2011 Lewis
2011/0087164 A1 4/2011 Mosler et al.
2011/0160701 A1 6/2011 Wyatt et al.
2011/0172636 A1 7/2011 Aasmul
2011/0175347 A1 7/2011 Okiyama
2011/0218511 A1 9/2011 Yokoyama
2011/0224640 A1 9/2011 Kuhn et al.
2011/0230856 A1 9/2011 Kyle et al.
2011/0264037 A1 10/2011 Foshee et al.
2011/0264069 A1 10/2011 Bochenko
2011/0276007 A1 11/2011 Denenburg
2011/0319827 A1 12/2011 Leinsing et al.
2012/0022469 A1 1/2012 Alpert
2012/0053555 A1 3/2012 Ariagno et al.
2012/0059346 A1 3/2012 Sheppard et al.
2012/0067429 A1 3/2012 Mosler et al.
2012/0078214 A1 3/2012 Finke et al.
2012/0123382 A1 5/2012 Kubo
2012/0184938 A1 7/2012 Lev et al.
2012/0215182 A1 8/2012 Mansour et al.
2012/0220977 A1 8/2012 Yow
2012/0220978 A1 8/2012 Lev et al.
2012/0265163 A1 10/2012 Cheng et al.
2012/0271229 A1 10/2012 Lev et al.
2012/0296307 A1 11/2012 Holt et al.
2012/0310203 A1 12/2012 Khaled et al.
2012/0323172 A1 12/2012 Lev et al.
2012/0323187 A1 12/2012 Iwase et al.
2012/0323210 A1 12/2012 Lev et al.
2013/0046269 A1 2/2013 Lev et al.
2013/0053814 A1 2/2013 Mueller-Beckhaus et al.
2013/0096493 A1 4/2013 Kubo et al.
2013/0144248 A1 6/2013 Putter et al.
2013/0199669 A1 8/2013 Moy et al.
2013/0226100 A1 8/2013 Lev
2013/0231630 A1 9/2013 Kraus et al.
2013/0237904 A1 9/2013 Deneburg et al.
2013/0253448 A1 9/2013 Baron et al.
2013/0289530 A1 10/2013 Wyatt et al.
2014/0020793 A1 1/2014 Denenburg et al.
2014/0096862 A1 4/2014 Aneas
2014/0150911 A1 6/2014 Hanner et al.
2014/0221940 A1 8/2014 Clauson et al.
2014/0277052 A1 9/2014 Haselby et al.
2014/0352845 A1 12/2014 Lev et al.
2015/0082746 A1 3/2015 Ivosevic et al.
2015/0088078 A1 3/2015 Lev et al.

(56) References Cited

U.S. PATENT DOCUMENTS

| | | | |
|---|---|---|---|
| 2015/0290390 | A1 | 10/2015 | Ring et al. |
| 2015/0305770 | A1 | 10/2015 | Fill et al. |
| 2016/0088995 | A1 | 3/2016 | Ueda et al. |

FOREIGN PATENT DOCUMENTS

| | | | |
|---|---|---|---|
| DE | 4122476 | A1 | 1/1993 |
| DE | 19504413 | A1 | 8/1996 |
| DE | 202004012714 | U1 | 11/2004 |
| DE | 202009011019 | U1 | 12/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0282545 | B1 | 2/1992 |
| EP | 0518397 | A1 | 12/1992 |
| EP | 0521460 | A1 | 1/1993 |
| EP | 0598918 | A1 | 6/1994 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887085 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |
| EP | 1498097 | A2 | 1/2005 |
| EP | 1872824 | A1 | 1/2008 |
| EP | 1911432 | A1 | 4/2008 |
| EP | 1919432 | A1 | 5/2008 |
| EP | 1930038 | A2 | 6/2008 |
| EP | 2090278 | A1 | 8/2009 |
| EP | 2351548 | A1 | 8/2011 |
| EP | 2351549 | A1 | 8/2011 |
| EP | 2462913 | A1 | 6/2012 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-097253 | A | 4/2004 |
| JP | 2004-522541 | A | 7/2004 |
| JP | 2010-179128 | A | 8/2010 |
| JP | 2012-205769 | A | 10/2012 |
| WO | 8601712 | A1 | 3/1986 |
| WO | 9003536 | A1 | 4/1990 |
| WO | 9403373 | A1 | 2/1994 |
| WO | 9507066 | A1 | 3/1995 |
| WO | 9600053 | A1 | 1/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0191693 | A2 | 12/2001 |
| WO | 0209797 | A1 | 2/2002 |
| WO | 0232372 | A1 | 4/2002 |
| WO | 0236191 | A2 | 5/2002 |
| WO | 02066100 | A2 | 8/2002 |
| WO | 02089900 | A1 | 11/2002 |
| WO | 03051423 | A2 | 6/2003 |
| WO | 03070147 | A2 | 8/2003 |
| WO | 03079956 | A1 | 10/2003 |
| WO | 2004041148 | A1 | 5/2004 |
| WO | 2005002492 | A1 | 1/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007101772 | A1 | 9/2007 |
| WO | 2007105221 | A1 | 9/2007 |
| WO | 2008081424 | A2 | 7/2008 |
| WO | 2008126090 | A1 | 10/2008 |
| WO | 2009026443 | A2 | 2/2009 |
| WO | 2009029010 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2010061743 | A1 | 6/2010 |
| WO | 2010117580 | A1 | 10/2010 |
| WO | 2011039747 | A1 | 4/2011 |
| WO | 2011058545 | A1 | 5/2011 |
| WO | 2011058548 | A1 | 5/2011 |
| WO | 2011077434 | A1 | 6/2011 |
| WO | 2011104711 | A1 | 9/2011 |
| WO | 2012063230 | A1 | 5/2012 |
| WO | 2012143921 | A1 | 10/2012 |
| WO | 2013127813 | A1 | 9/2013 |
| WO | 2013134246 | A1 | 9/2013 |
| WO | 2013156944 | A1 | 10/2013 |
| WO | 2014033706 | A2 | 3/2014 |
| WO | 2014033710 | A1 | 3/2014 |

OTHER PUBLICATIONS

Novel Transfer, Mixing and Drug Delivery Systems, MOP Medimop Medical Projects Ltd. Catalog, 4 pages, Rev. 4, 2004.

Office Action dated Oct. 6, 2003 in U.S. Appl. No. 10/062,796.

Office Action dated Feb. 22, 2005 in U.S. Appl. No. 10/062,796.

Office Action dated Oct. 5, 2005 in U.S. Appl. No. 10/062,796.

Office Action dated Feb. 20, 2009 in U.S. Appl. No. 11/694,297.

Intl Search Report dated Dec. 6, 2006 in Int'l Application No. PCT/IL2006/000912.

Int'l Preliminary Report on Patentability dated Dec. 4, 2007 in Int'l Application No. PCT/IL2006/000912.

http://www.westpharma.com/en/products/Pages/Mixject.aspx.

http://www.westpharma.com/SiteCollectionDocuments/Recon/mixject%20product%20sheet.pdf; MIXJECT product information sheet pp. 1.

(56) References Cited

OTHER PUBLICATIONS

Int'l Search Report dated Jul. 27, 2007 in Int'l Application No. PCT/IL2007/000343.
Int'l Preliminary Report on Patentability dated Jun. 19, 2008 in Int'l Application No. PCT/IL2007/000343.
Int'l Search Report dated Mar. 27, 2009 in Int'l Application No. PCT/US2008/070024.
Int'l Search Report dated Oct. 17, 2005 in Int'l Application No. PCT/IL2005/000376.
Int'l Preliminary Report on Patentability dated Jun. 19, 2006 in Int'l Application No. PCT/IL2005/000376.
Written Opinion of ISR dated Jun. 19, 2006 in Int'l Application No. PCT/IL2005/000376.
Int'l Search Report dated Aug. 25, 2008 in Int'l Application No. PCT/IL2008/000517.
Written Opinion of the ISR dated Oct. 17, 2009 in Int'l Application No. PCT/IL08/00517.
Int'l Preliminary Report on Patenability dated Oct. 20, 2009 in Int'l Application No. PCT/IL2008/000517.
Written Opinion of the Int'l Searching Authority dated Oct. 27, 2008 in Int'l Application No. PCT/US2008/070024.
Int'l Search Report dated Mar. 12, 2009 in Int'l Application No. PCT/IL2008/001278.
Office Action dated Jan. 20, 2010 in JP Application No. 2007-510229.
Office Action dated Apr. 20, 2010 in U.S. Appl. No. 11/997,569.
Int'l Search Report dated Nov. 20, 2006 in Int'l Application No. PCT/IL2006/000881.
Office Action dated May 27, 2010 in U.S. Appl. No. 11/559,152.
Decision to Grant dated Apr. 12, 2010 in EP Application No. 08738307.1.
Office Action dated Jun. 1, 2010 in U.S. Appl. No. 11/568,421.
Office Action dated Nov. 12, 2010 in U.S. Appl. No. 29/334,697.
The MixJect transfer system, as shown in the article, "Advanced Delivery Devices," Drug Delivery Technology Jul./ Aug. 2007 vol. 7 No. 7 [on-line]. [Retrieved from Internet May 14, 2010.] URL: <http://www.drugdeiverytech-online.com/drugdelivery/200707/?pg=28pg28>. (3 pages).
Publication date of Israeli Patent Application 186290 [on-line]. ]Retrieved from Internet May 24, 2010]. URL:<http://www.ilpatsearch.justrice.gov.il/UI/RequestsList.aspx>. (1 page).
Int'l Search Report dated Nov. 25, 2010 in Int'l Application No. PCT/IL2010/000530.
Office Action dated Feb. 7, 2011 in U.S. Appl. No. 12/783,194.
Office Action dated Dec. 20, 2010 in U.S. Appl. No. 12/063,176.
Office Action dated Dec. 13, 2010 in U.S. Appl. No. 12/293,122.
Office Action dated Nov. 29, 2010 in U.S. Appl. No. 11/568,421.
Office Action dated Dec. 23, 2010 in U.S. Appl. No. 29/334,696.
Int'l Search Report dated Mar. 17, 2011 in Int'l Application No. PCT/IL2010/000854.
Overview—Silicone Rubber [retrieved from http://www.knovel.com/web/portal/browse/display? EXT_KNOVEL_DISPLAY_bookid=1023&VerticalID=0 on Feb. 9, 2011].
Int'l Search Report dated Mar. 17, 2011 in Int'l Application No. PCT/IL2010/00915.
Office Action dated May 12, 2011 in U.S. Appl. No. 12/063,176.
Office Action dated Jul. 11, 2011 in U.S. Appl. No. 12/293,122.
Int'l Search Report dated Jul. 12, 2011 in Int'l Application No. PCT/IL2011/000187.
Int'l Search Report dated Jul. 12, 2011 in Int'l Application No. PCT/IL2011/000186.
Office Action dated Aug. 3, 2011 in JP Application No. 2008-525719.
Int'l Search Report dated Oct. 7, 2011 in Int'l Application No. PCT/IL2011/000511.
Int'l Search Report dated Mar. 6, 2012 in Int'l Application No. PCT/IL2011/000834; Written Opinion.
Office Action dated Mar. 1, 2012 in JP Application No. 2007-510229.
Int'l Search Report issued Mar. 7, 2012 in Int'l Application No. PCT/IL2011/000829; Written Opinion.
Office Action dated Mar. 13, 2012 in CA Application No. 2,563,643.
Office Action dated Mar. 1, 2012 in CN Application No. 2008801108283.4.
Written Opinion dated Apr. 10, 2015 in Int'l Application No. PCT/IL2014/050405.
Response to Written Opinion dated Mar. 9, 2015 in Int'l Application No. PCT/IL2014/050405.
Int'l Preliminary Report on Patentability dated Aug. 24, 2015 in Int'l Application No. PCT/IL2014/050405.
U.S. Appl. No. 14/888,590 by Marks, filed Nov. 2, 2015.
Office Action dated Oct. 5, 2015 in U.S. Appl. No. 14/385,212 by Lev.
Office Action dated Mar. 6, 2012 in U.S. Appl. No. 12/678,928.
Int'l Search Report dated Feb. 3, 2011 in Int'l Application No. PCT/IL2010/000777; Written Opinion.
Int'l Search Report dated Mar. 17, 2011 in Int'l Application No. PCT/IL2010/000854; Written Opinion.
Int'l Search Report dated Mar. 17, 2011 in Int'l Application No. PCT/IL2010/000915; Written Opinion.
U.S. Appl. No. 13/505,790 by Lev, filed May 3, 2012.
U.S. Appl. No. 13/505,881 by Lev, filed May 3, 2012.
U.S. Appl. No. 13/522,410 by Lev, filed Jul. 16, 2012.
U.S. Appl. No. 13/576,461 by Lev, filed Aug. 1, 2012.
Office Action dated Jun. 14, 2012 in U.S. Appl. No. 29/376,980.
Office Action dated Jun. 15, 2012 in U.S. Appl. No. 29/413,170.
Office Action dated Jun. 21, 2012 in U.S. Appl. No. 12/596,167.
Alaris Medical Systems Product Brochure, 4 pages, Issue 1, Oct. 11, 1999.
Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ULTRASITE.RTM. Valve, B. Braun Medical, Inc. website and product description, 3 pages, Feb. 2006.
Int'l Search Report dated Aug. 16, 2012 in Int'l Application No. PCT/IL2012/000164.
U.S. Appl. No. 29/438,134 by Lev, filed Nov. 27, 2012.
U.S. Appl. No. 29/438,141 by Gilboa, filed Nov. 27, 2012.
Int'l Search Report dated Jan. 22, 2013 in Int'l Application No. PCT/IL2012/000354.
Int'l Search Report dated Mar. 18, 2013 in Int'l Application No. PCT/IL2012/050516.
Office Action dated Apr. 2, 2013 in U.S. Appl. No. 13/505,790.
Int'l Search Report and Written Opinion dated Mar. 6, 2012 in Int'l Application No. PCT/IL2011/000834.
U.S. Appl. No. 13/883,289 by Lev, filed May 3, 2013.
Int'l Search Report & Written Opinion dated Mar. 7, 2012 in Int'l Application No. PCT/IL2011/000829.
U.S. Appl. No. 13/884,981 by Denenburg, filed May 13, 2013.
Office Action dated May 31, 2013 in U.S. Appl. No. 13/505,790.
Int'l Search Report dated Jun. 5, 2013 in Int'l Application No. PCT/IL2012/050407.
Int'l Search Report dated Jun. 19, 2013 in Int'l Application No. PCT/IL2013/050167.
Int'l Search Report dated Jul. 1, 2013 in Int'l Application No. PCT/IL2013/050180.
Int'l Search Report dated Jul. 31, 2013 in Int'l Application No. PCT/IL2013/050313.
Int'l Search Report dated Jul. 26, 2013 in Int'l Application No. PCT/IL2013/050316.
English translation of an Office Action dated Jun. 19, 2013 in JP Application No. 2012-531551.
Office Action dated Aug. 20, 2013 in U.S. Appl. No. 13/576,461 by Lev.
Int'l Preliminary Report on Patentability dated Aug. 28, 2012 in Int'l Application No. PCT/IL2011/000186.
English translation of an Office Action dated Jul. 26, 2013 in JP Application No. 2012-538464.
International Search Report dated Jan. 23, 2007 in Int'l Application No. PCT/IL/2006/001228.

(56) References Cited

OTHER PUBLICATIONS

IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Drug Administration Systems product information sheets; http://www.westpharma.com/eu/en/products/Pages/Vial2Bag.aspx; pp. 1-3.
Office Action dated Jun. 8, 2010 in U.S. Appl. No. 12/112,490 by Zinger.
Office Action dated Sep. 28, 2010 in U.S. Appl. No. 12/112,490 by Zinger.
Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages see pp. 5-6).
Office Action dated Jun. 15, 2011 in JP Application No. 2008-538492.
Translation of Office Action dated Jun. 18, 2012 in JP Application No. 2008-538492.
Translation of Office Action dated Apr. 15, 2013 in JP Application No. 2008-538492.
Office Action dated Jul. 13, 2012 in U.S. Appl. No. 12/112,490 by Zinger.
Office Action dated Jan. 23, 2013 in U.S. Appl. No. 12/112,490 by Zinger.
Int'l Preliminary Report on Patentability dated May 6, 2008 in Int'l Application No. PCT/IL2006/001228.
Written Opinion dated Aug. 16, 2012 in Int'l Application No. PCT/IL2012/000164.
English translation of an Office Action dated Sep. 10, 2013 in JP Application No. 2012-554468.
Office Action dated Nov. 11, 2013 in IL Application No. 218730.
U.S. Appl. No. 29/478,723 by Lev, filed Jan. 8, 2014.
U.S. Appl. No. 29/478,726 by Lev, filed Jan. 8, 2014.
Office Action dated Jan. 2, 2014 in U.S. Appl. No. 13/505,881 by Lev.
Int'l Preliminary Report on Patentability dated Sep. 24, 2013 in Int'l Application No. PCT/IL2012/000354.
Office Action dated Feb. 13, 2014 in U.S. Appl. No. 13/884,981 by Denenburg.
U.S. Appl. No. 14/345,094 by Lev, filed Mar. 14, 2014.
Int'l Search Report and Written Opinion dated Jan. 7, 2014 in Int'l Application No. PCT/IL2012/050721.
English translation of an Office Action dated Jan. 9, 2014 in JP Application No. 2010-526421.
English translation of an Office Action dated Dec. 4, 2013 in CN Application No. 201080051210.3.
English translation of an Office Action dated Dec. 25, 2013 in CN Application No. 201180006530.1.
Office Action dated Nov. 28, 2013 in IN Application No. 4348/DELNP/2008.
Office Action dated Oct. 8, 2013 in CN Application No. 201080043825.1.
English translation of an Office Action dated Feb. 4, 2014 in JP Application No. 2012-554468.
Office Action dated Jan. 17, 2014 in CN Application No. 201180006534.X.
Int'l Search Report and Written Opinion dated May 8, 2014 in Int'l Application No. PCT/IL2013/050706.
English translation of an Office Action dated Apr. 28, 2014 in JP Application No. 2013-537257.
Int'l Preliminary Report on Patentability dated Jan. 14, 2014 in Int'l Application No. PCT/IL2012/050516.
Office Action dated May 6, 2014 in U.S. Appl. No. 13/505,881 by Lev.
U.S. Appl. No. 14/366,306 by Lev, filed Jun. 18, 2014.
Office Action dated Apr. 17, 2014 in CN Application No. 201080051201.4.
Int'l Search Report and Written Opinion dated Jul. 16, 2014 in Int'l Application No. PCT/IL2014/050327.
English translation of an Office Action dated Jun. 30, 2014 in CN Application No. 201180052962.6.
Extended European Search Report dated Jun. 3, 2014 in EP Application No. 08781828.2.
Written Opinion dated Jul. 1, 2013 in Int'l Application No. PCT/IL2013/050180.
Int'l Preliminary Report on Patentability dated Apr. 1, 2014 in Int'l Application No. PCT/IL2013/050180.
Written Opinion dated Jul. 31, 2013 in Int'l Application No. PCT/IL2013/050313.
Int'l Preliminary Report on Patentability dated May 12, 2014 in Int'l Application No. PCT/IL2013/050316.
Office Action dated Jul. 31, 2014 in U.S. Appl. No. 29/438,141 by Gilboa.
U.S. Appl. No. 14/385,212 by Lev, filed Sep. 15, 2014.
U.S. Appl. No. 29/502,037 by Lev, filed Sep. 11, 2014.
U.S. Appl. No. 29/502,053 by Lev, filed Sep. 11, 2014.
U.S. Appl. No. 14/391,792 by Lev, filed Oct. 10, 2014.
U.S. Appl. No. 14/504,979 by Lev, filed Oct. 2, 2014.
Int'l Search Report and Written Opinion dated Sep. 2, 2014 in Int'l Application No. PCT/IL2014/050405.
Int'l Search Report and Written Opinion dated Oct. 17, 2014 in Int'l Application No. PCT/IL2014/050680.
English translation of an Office Action dated Aug. 28, 2014 in JP Application No. 2013-168885.
Written Opinion dated Jun. 5, 2013 in Int'l Application No. PCT/IL2012/050407.
Int'l Preliminary Report on Patentability dated Aug. 20, 2014 in Int'l Application No. PCT/IL2012/050407.
Office Action dated Jan. 2, 2015 in U.S. Appl. No. 29/438,141 by Gilboa.
Office Action dated Jan. 5, 2015 in U.S. Appl. No. 29/413,220 by Lev.
Office Action dated Jan. 7, 2015 in U.S. Appl. No. 29/438,134 by Lev.
U.S. Appl. No. 14/423,595 by Lev, filed Feb. 24, 2015.
U.S. Appl. No. 14/423,612 by Lev, filed Feb. 24, 2015.
U.S. Appl. No. 14/425,582 by Lev, filed Mar. 3, 2015.
Office Action dated Mar. 17, 2015 in U.S. Appl. No. 14/504,979 by Lev.
Office Action dated Apr. 9, 2015 in U.S. Appl. No. 13/883,289 by Lev.
Office Action dated May 28, 2015 in U.S. Appl. No. 14/391,792 by Lev.
Office Action dated Aug. 24, 2015 in U.S. Appl. No. 14/366,306 by Lev.
Office Action dated Mar. 10, 2015 in EP Application No. 12 812 395.7.
Office Action dated Aug. 7, 2015 in JP Application No. 2015-529206.
Office Action dated Dec. 9, 2015 in U.S. Appl. No. 29/478,723 by Lev.
West, Vial2Bag DC system, Oct. 2, 2014, https://web.archive.org/web/20141002065133/http://www.westpharma.com/en/products/Pages/Reconstitutionsystems.aspx.
Youtube.com, Vial2Bag DC, Aug. 21, 2014, https://www.youtube.com/watch?v=FEOkglxNBrs.
Office Action dated Dec. 9, 2015 in U.S. Appl. No. 29/478,726 by Lev.
Notice of Allowance dated Jan. 12, 2016 in U.S. Appl. No. 14/385,212 by Lev.
Notice of Allowance dated Mar. 17, 2016 in U.S. Appl. No. 29/502,037 by Lev.
Office Action dated Mar. 25, 2016 in U.S. Appl. No. 29/478,726 by Lev.
Office Action dated Mar. 28, 2016 in JP Application No. 2016-507113.
Int'l Search Report and Written Opinion dated Sep. 14, 2016 in Int'l Application No. PCT/IL2016/050709.
Int'l Search Report and Written Opinion dated Oct. 11, 2016 in Int'l Application No. PCT/IL2016/050782.

(56) References Cited

OTHER PUBLICATIONS

Office Action dated Dec. 21, 2016 in IL Application No. 228452.
Extended European Search Report dated Feb. 16, 2017 in EP Application No. 16200458.
Vial-Mate Adapter Device, Baxter, May 2017, downloaded from web page:http://www.baxtermedicationdeliveryproducts.com/drug-delivery/vialmate.html, Download Date: Jul. 28, 2017, original posting date: unknown, 1page.

DRUG CONTAINER CLOSURE FOR MOUNTING ON OPEN-TOPPED DRUG CONTAINER TO FORM DRUG RECONSTITUTION ASSEMBLAGE FOR USE WITH NEEDLELESS SYRINGE

FIELD OF THE INVENTION

The invention relates to drug container closures for mounting on open-topped drug containers to form so-called ready-to-use drug reconstitution assemblages for use with needleless syringes. The drug container closures include a drug container stopper for sealing an open-topped drug container and a fluid transfer member with an integral needleless syringe connector and puncturing cannula.

BACKGROUND OF THE INVENTION

Ready-to-use drug reconstitution assemblages including an open-topped drug container and a drug container closure having a fluid transfer member with an integral needleless syringe connector and puncturing cannula are known in the prior art. Exemplary prior art includes inter alia:

U.S. Pat. No. 4,576,211 to Valentini et al. entitled Safety device for connection of a syringe with the mouth or opening of a bottle containing a drug or a small tube for drug delivery from the syringe U.S. Pat. No. 5,429,614 to Fowles et al. entitled Drug delivery system U.S. Pat. No. 5,776,116 to Lopez et al. entitled Medical connector U.S. Pat. No. 5,902,280 to Powles et al. entitled Aspiration needle apparatus incorporating its own vacuum and method and adapter for use therewith U.S. Pat. No. 6,070,623 to Aneas entitled Connecting device in particular between a receptacle with a stopper capable of being perforated and a syringe U.S. Pat. No. 6,382,442 to Thibault et al. entitled Plastic closure for vials and other medical containers U.S. Pat. No. 6,478,788 to Aneas entitled Device for connection between a recipient and a container and ready-to-use assembly comprising such a device U.S. Pat. No. 6,706,031 to Manera entitled Needleless access apparatus and system U.S. Pat. No. 7,074,216 to Fowles et al. entitled Sliding reconstitution device for a diluent container U.S. Pat. No. 7,195,623 to Burroughs et al. entitled Kit including side firing syringe needle for preparing a drug in an injection pen cartridge U.S. Pat. No. 7,615,041 to Sullivan et al. entitled Vial adapter U.S. Pat. No. 8,225,949 to Aneas entitled Plug device for a container and container provided with one such device U.S. Pat. No. 8,480,646 to Nord et al. entitled Medical device connector U.S. Pat. No. 8,562,582 to Tuckwell et al. entitled Reconstitution device US Patent Application Publication No. 2012/0310203 entitled Apparatus and method US Patent Application Publication No. 2013/0053814 entitled Device There is a need for improved ready-to-use drug reconstitution assemblages including an open-topped drug container and a drug container closure mounted thereon.

SUMMARY OF THE INVENTION

The present invention is directed toward drug container closures for mounting on an open-topped drug container to form a so-called ready-to-use drug reconstitution assemblage for use with a needleless syringe.

The drug container closures include three major components as follows: a closure housing for securely mounting on an open-topped drug container, a drug container stopper securely mounted on the closure housing for sealing the drug container, and a fluid transfer member slidingly mounted on the closure housing. The fluid transfer member includes a needleless syringe connector integrally formed with a puncturing cannula for puncturing the drug container stopper and in flow communication with the needleless syringe connector.

The closure housing preferably includes a diametric inverted L-shaped track pair for guiding downward displacement of the fluid transfer member from an initial non-puncturing position to a final puncturing position. Alternatively, closure housings can be designed with a single inverted L-shaped track or three or more inverted L-shaped tracks.

The inverted L-shaped tracks are configured to require a user to perform two actions for guiding a fluid transfer member from its initial non-puncturing position to its final puncturing position as follows: An initial minor clockwise rotation for priming the drug reconstitution assemblage ready for activation and a subsequent major activation displacement for puncturing a drug container stopper. The inverted L-shaped tracks ensure a secure path precluding inadvertent pre-puncturing and include one-way snap members to prevent a user returning the fluid transfer member to an earlier position thereby affording tamper evidence. The one-way snap members also afford audible user indications for indicating to proceed to the next user action.

The drug container closures can have closure housings with either open or closed inverted L-shaped tracks. The former requires an additional sheath for hermetically sealing a downward depending puncturing cannula. The latter requires an additional sleeve exterior mounted on the closure housing for sealing the open tracks thereby precluding the need for the additional sheath.

The fluid transfer members can be provided in a vented version or a non-vented version. The needleless syringe connectors can be formed as a female Luer connector. The needleless syringe connectors can be formed as a swabbable self-sealing port for multiple aspirations of liquid drug contents.

BRIEF DESCRIPTION OF DRAWINGS

In order to understand the invention and to see how it can be carried out in practice, preferred embodiments will now be described, by way of non-limiting examples only, with reference to the accompanying drawings in which similar parts are likewise numbered, and in which.

DETAILED DESCRIPTION OF PREFERRED EMBODIMENTS OF THE INVENTION

Figure 1:
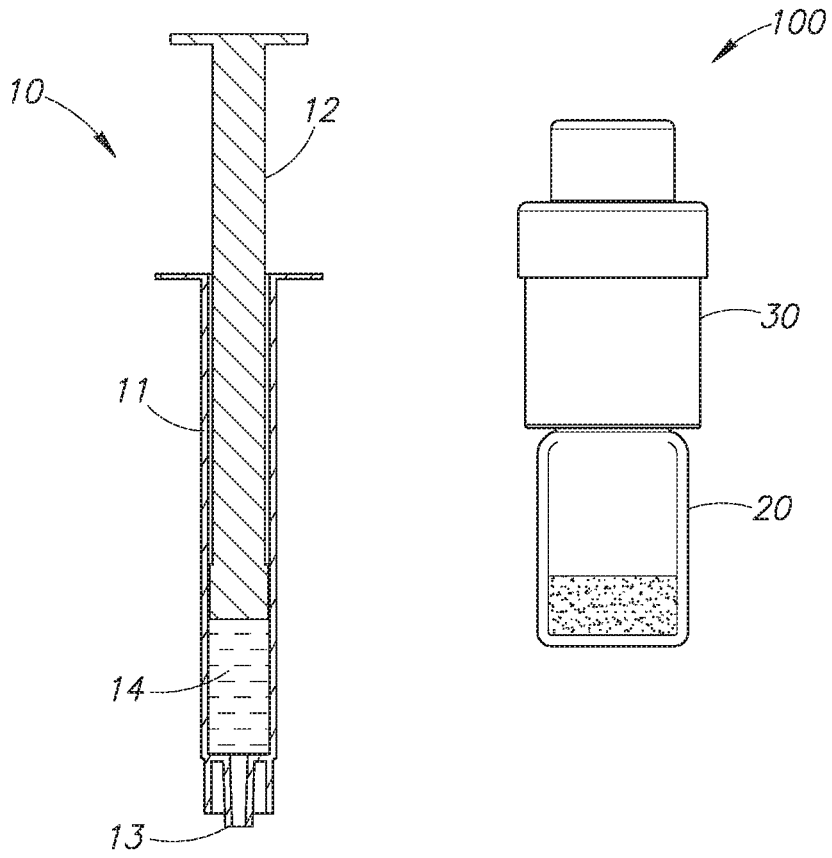
FIG. 1 is a pictorial representation of a first embodiment of a drug reconstitution assemblage in accordance with the present invention in an initial non-puncturing position for use with a needleless syringe.

FIG. 1 shows a ready-to-use drug reconstitution assemblage 100 for use with a needleless syringe 10 constituting a source of physiological fluid. The drug reconstitution assemblage 100 includes an open-topped drug container 20 constituted by an open-topped drug vial and a drug container closure 30 securely mounted thereon. The open-topped drug container 20 can be alternatively constituted by other medical containers and receptacles for storing powder or liquid drugs.

The syringe 10 includes a barrel 11 with a plunger 12 and a male Luer lock connector 13. The syringe 10 can be formed with other types of male connectors. The syringe 10 is filled with a liquid component 14. The liquid component 14 can be diluent only. Alternatively, the liquid component 14 can include an active component.

Figure 2:
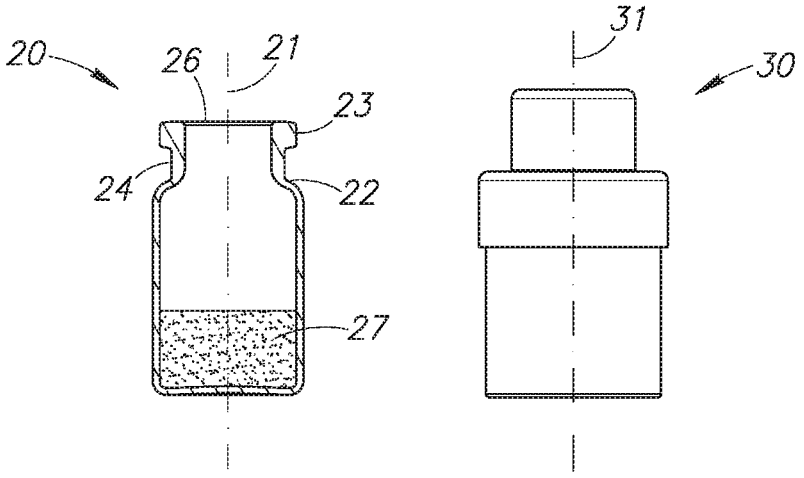
FIG. 2 is a dissembled front elevation view of the FIG. 1 drug reconstitution assemblage.
Figure 3:
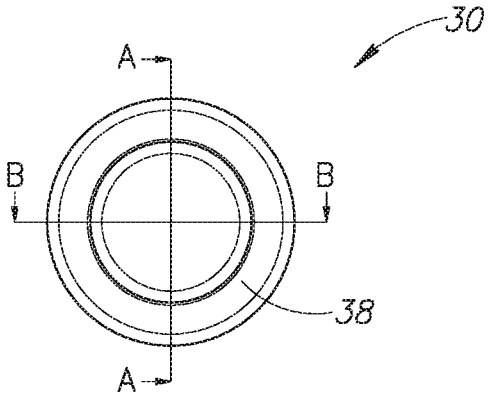
FIG. 3 is a top elevation view of the FIG. 1 drug reconstitution assemblage.
Figure 4:
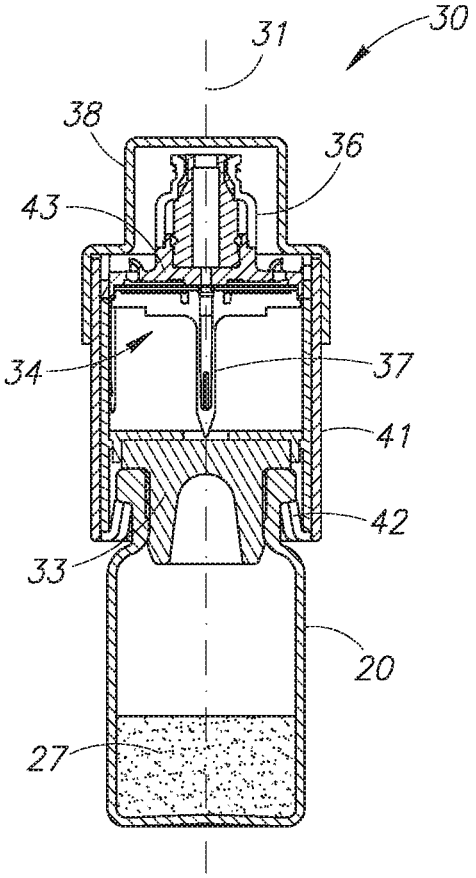
FIG. 4 is a longitudinal cross section of the FIG. 1 drug reconstitution assemblage along line A-A in FIG. 3.
Figure 5:
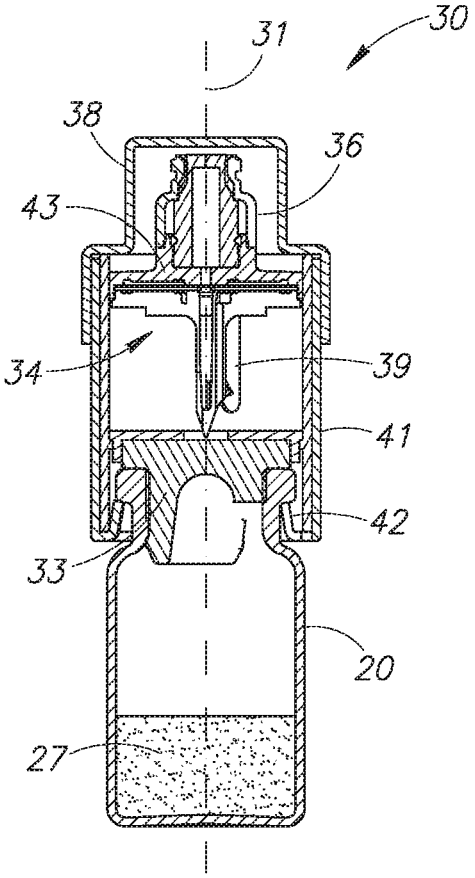
FIG. 5 is a longitudinal cross section of the FIG. 1 drug reconstitution assemblage along line B-B in FIG. 3.
Figure 6:
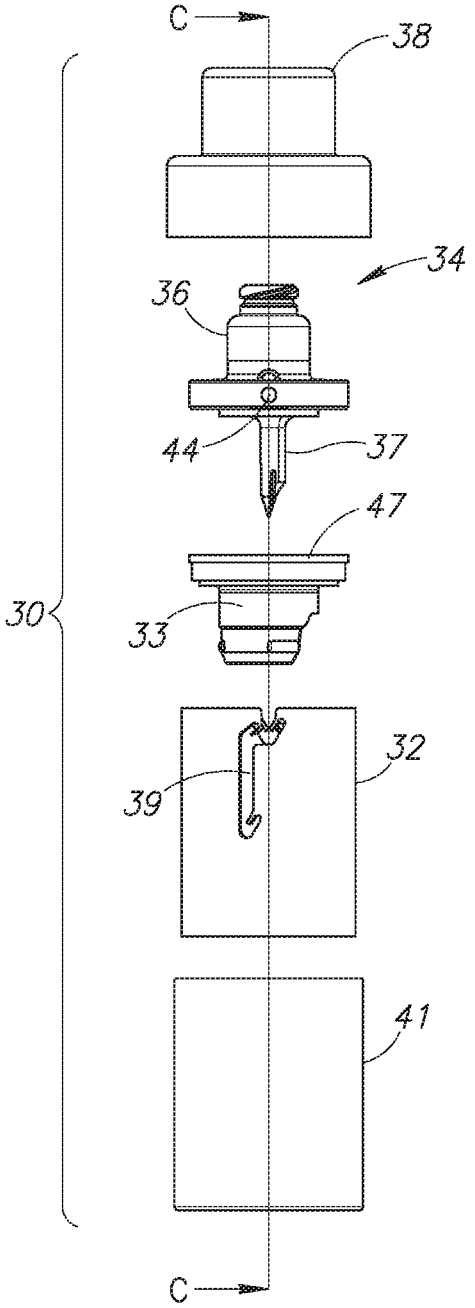
FIG. 6 is an exploded front elevation view of the FIG. 1 drug reconstitution assemblage.
Figure 7:
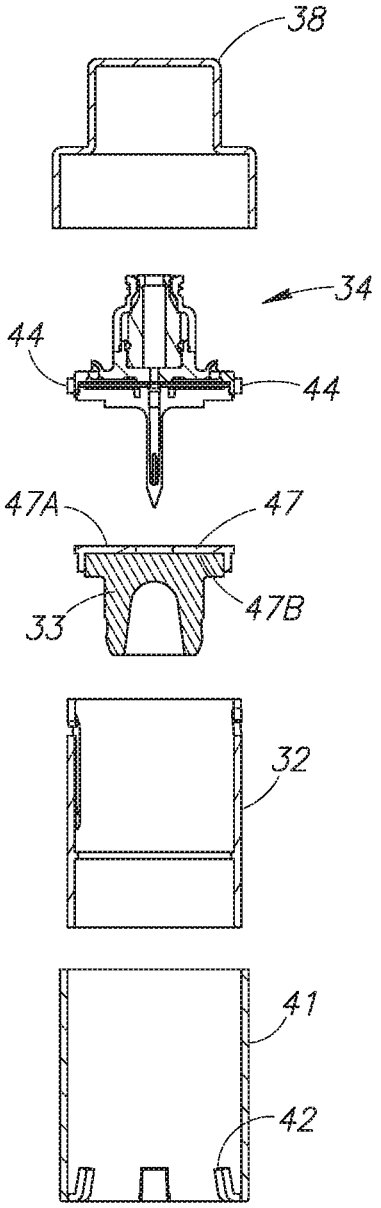
FIG. 7 is a longitudinal cross section of the FIG. 1 drug reconstitution assemblage along line C-C in FIG. 6.
Figure 8:
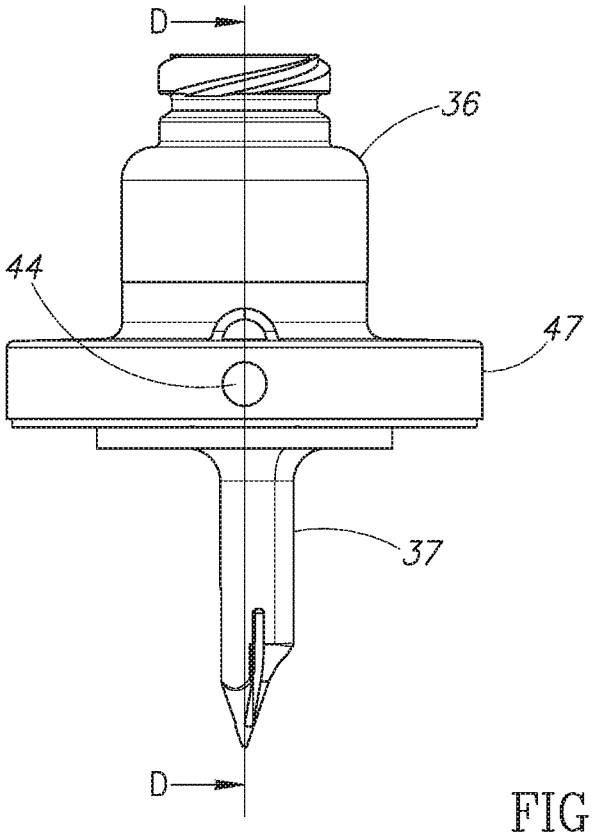
FIG. 8 is a front elevation view of FIG. 6's fluid transfer member with integral needleless syringe connector and puncturing cannula.
Figure 9:
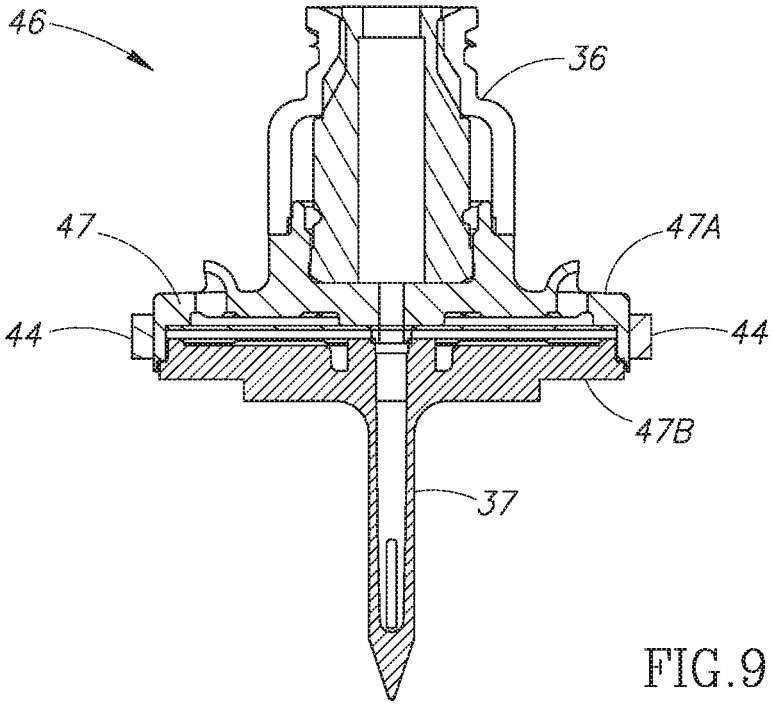
FIG. 9 is a longitudinal cross section of the FIG. 8 fluid transfer member along line D-D thereon.
Figure 10:
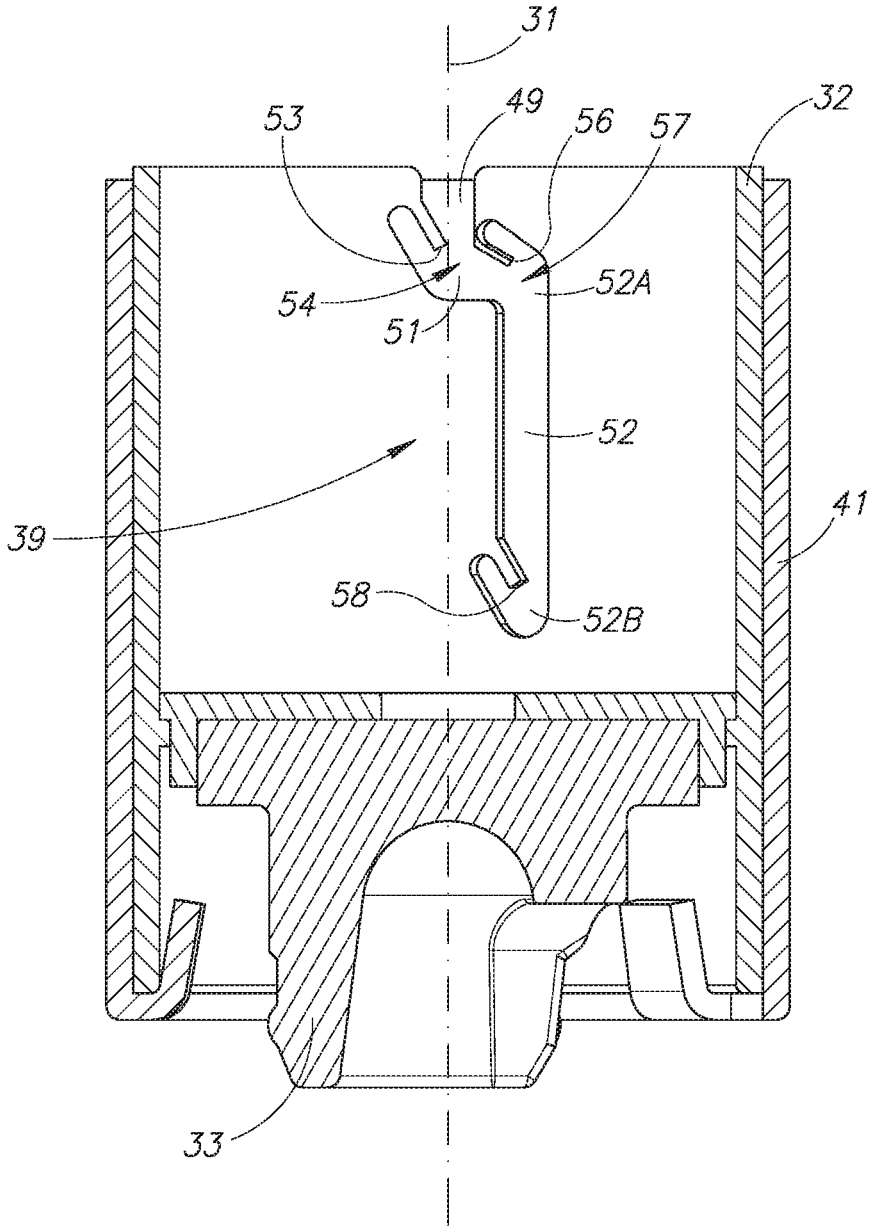
FIG. 10 is a longitudinal cross section of the FIG. 1 drug container closure's closure housing and the drug container stopper.

FIG. 2 shows the open-topped drug vial 20 has a longitudinal axis 21 and includes a drug vial shoulder 22, a drug vial rim 23 and an intermediate narrow drug vial neck 24. The drug vial rim 23 defines a drug vial opening 26. The drug vial 20 contains a powder or liquid drug 27.

FIGS. 2 to 13 show the drug container closure 30 includes a longitudinal centerline 31 and a closure housing 32 for secure snap fit mounting on the drug vial 20 and a drug container stopper 33 for sealing the drug vial opening 26. The closure housing 32 accommodates a fluid transfer member 34 sliding displaceable from an initial non-puncturing position to a final puncturing position for puncturing the drug container stopper 33. The fluid transfer member 34 includes an integral needleless syringe connector 36 and a puncturing cannula 37 in flow communication with the syringe connector 36. The needleless syringe connector 36 is formed as a swabbable female Luer connector for screw thread mounting of a male connector 13 thereon. The drug container closure 30 includes a closure cap 38 for sealing the needleless syringe connector 36.

The closure housing 32 is made from suitable plastic material and includes a diametric inverted L-shaped track pair 39 for guiding activation displacement of the fluid transfer member 34 from its initial non-puncturing position to its final puncturing position. The drug container closure 30 includes a sleeve 41 exterior to the closure housing 32 for sealing the diametric inverted L-shaped track pair 39 to ensure sterility of the puncturing cannula 37. The sleeve 41 includes snap fit members 42 for snap fitting onto the drug vial rim 23 on downward depression of the drug container closure 30 onto the drug vial 20 during assembly of the ready-to-use drug reconstitution assemblage 100.

The fluid transfer member 34 includes a circular base member 43 formed with the needleless syringe connector 36 and the puncturing cannula 37. The base member 43 includes a diametrical outward directed pin pair 44 for travelling along the diametric inverted L-shaped track pair 39 for guided activation displacement of the fluid transfer member 34. The fluid transfer member 34 optionally includes a venting arrangement 46 as disclosed in commonly owned WIPO International Publication No. WO 2011/104712 entitled Liquid Drug Transfer Device with Vented Vial Adapter.

The closure housing 32 includes a cross member 47 having a cross member upperside 47A and a cross member underside 47B and formed with a central aperture 48 for passage therethrough of the puncturing cannula 37. The cross housing underside 47B is integrally formed with the drug container stopper 33. The cross member 47 and the drug container stopper 33 can be overmolded together. Alternatively, the cross member 47 can be mechanically attached to the drug container stopper 33, swaged thereto, adhered thereto, and the like.

The inverted L-shaped tracks 39 each include an open-ended upright access leg 49 co-directional with the longitudinal centerline 31, a horizontal priming leg 51 transverse to the longitudinal centerline 31, and an upright activation leg 52 co-directional with the longitudinal centerline 31. The major upright activation leg 52 has a proximal activation leg end 52A and a distal activation leg end 54B correspondingly adjacent and distal to the priming leg 51.

The inverted L-shaped tracks 39 also each include three one-way snap members as follows:

An one-way retaining snap member 53 at a juncture 54 between the open-ended upright access leg 49 and the horizontal priming leg 51. The one-way retaining snap member 53 retains the fluid transfer member 34 in the closure housing 32 before use.

An one-way primed snap member 56 at a juncture 57 between the horizontal priming leg 51 and the proximal activation leg end 52A.

An one-way activated snap member 58 at the distal activation leg end 52B.

Figure 11:
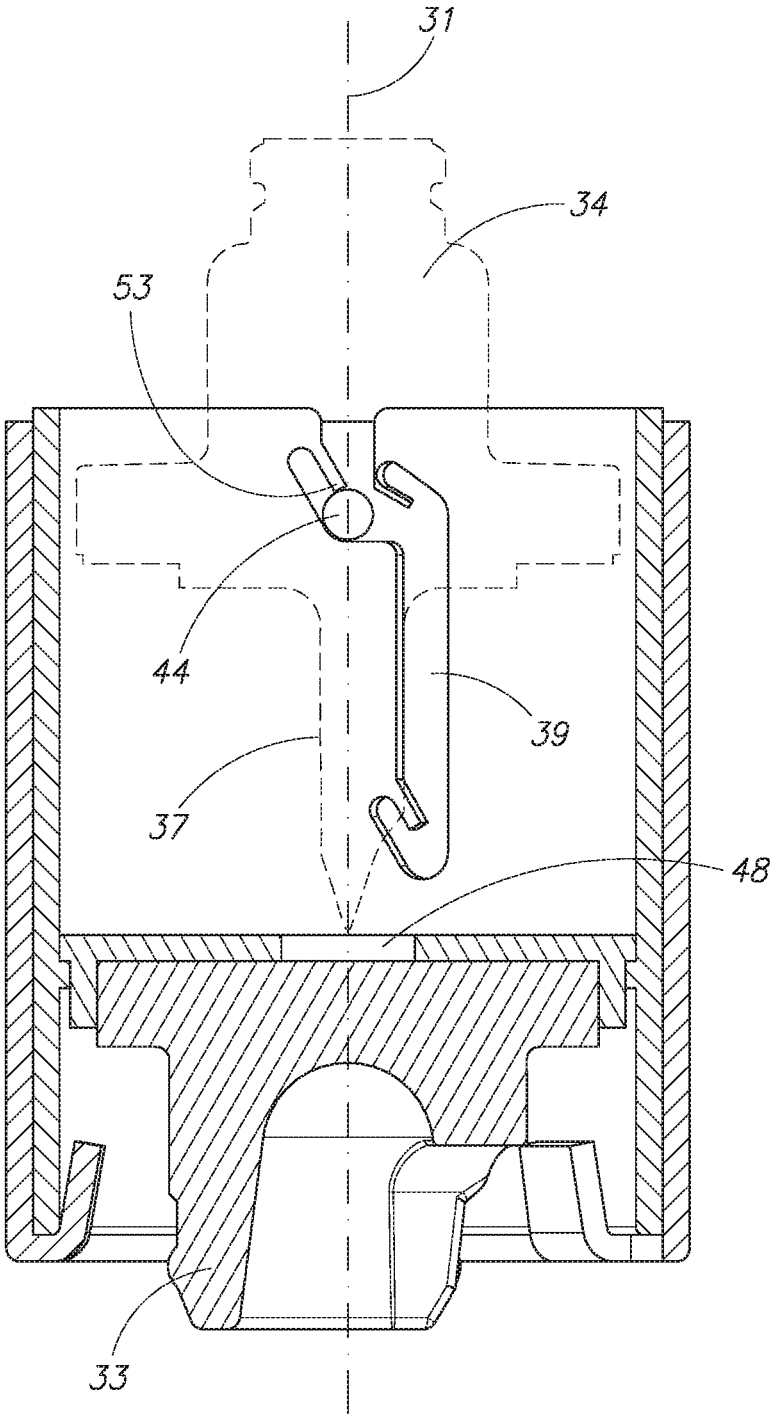
FIG. 11 is a longitudinal cross section of the FIG. 1 drug container closure in an initial non-puncturing position.

FIG. 11 shows the fluid transfer member 34 in its initial set-up position before use. The outward directed pin pair 44 are located along the horizontal priming leg pair 51 past the one-way retaining snap member pair 53 and before the one-way primed snap member pair 56. The puncturing cannula 36 is deployed above the central aperture 48 in position to puncture the drug container stopper 33.

Figure 12:
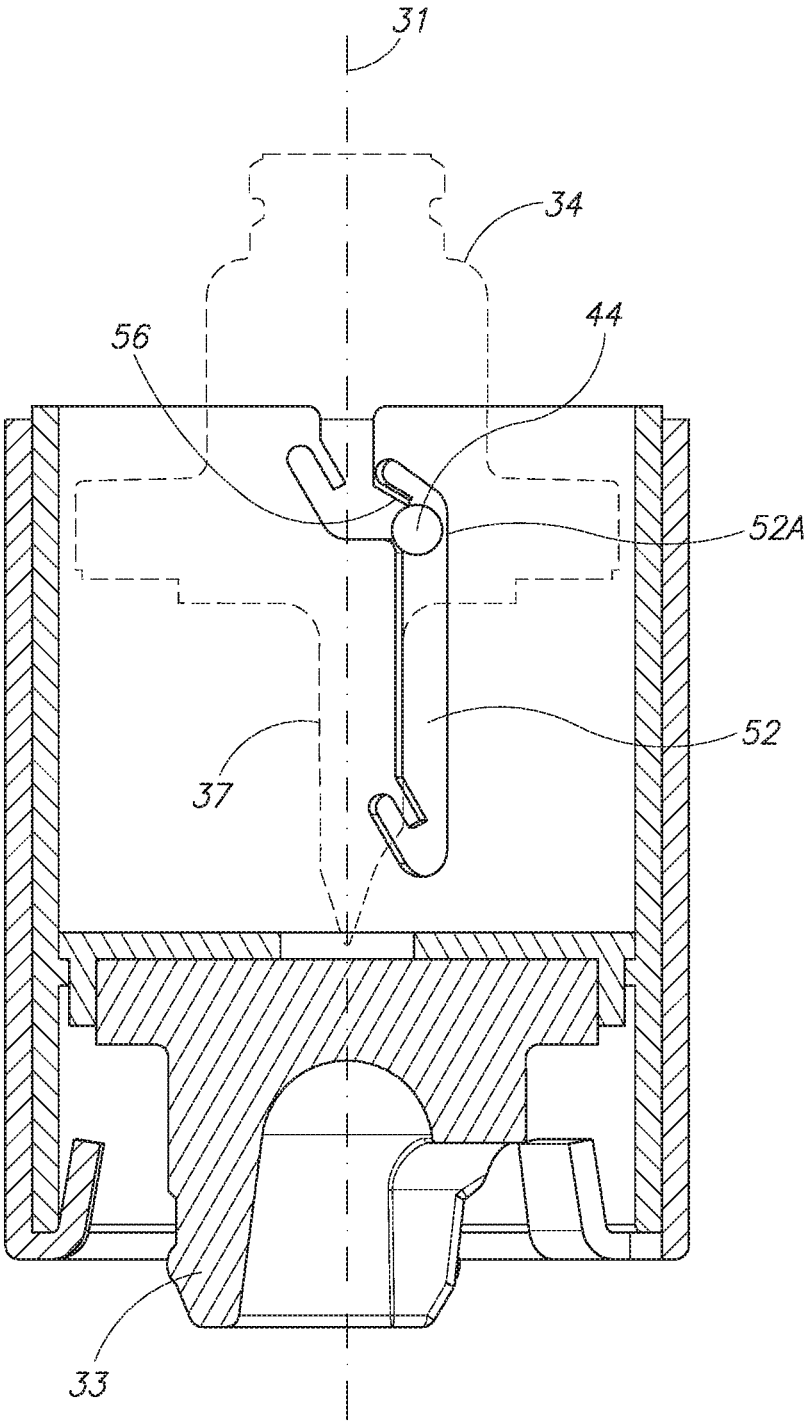
FIG. 12 is a longitudinal cross section of the FIG. 1 drug container closure being urged to a primed position ready for activation.

FIG. 12 shows the fluid transfer member 34 being urged past the one-way primed snap member pair 56 to its primed position at the proximal activation leg end pair 52A ready for activation. This position is enabled by a user screw threading a needleless syringe 10 onto the drug reconstitution assemblage 100 and proceeding to rotate the needleless syringe 10 in a clockwise tightening direction until the outward directed pin pair 44 snap past the one-way primed snap member pair 56. The user hears a click as the outward directed pin pair 44 snap past the one-way primed snap member pair 56 for indicating that he can proceed with activation. The puncturing cannula 36 remains deployed above the central aperture 48 in position to puncture the drug container stopper 33. The one-way primed snap member pair 56 prevent the fluid transfer member 34 to be returned to the horizontal priming leg pair 51.

Figure 13:
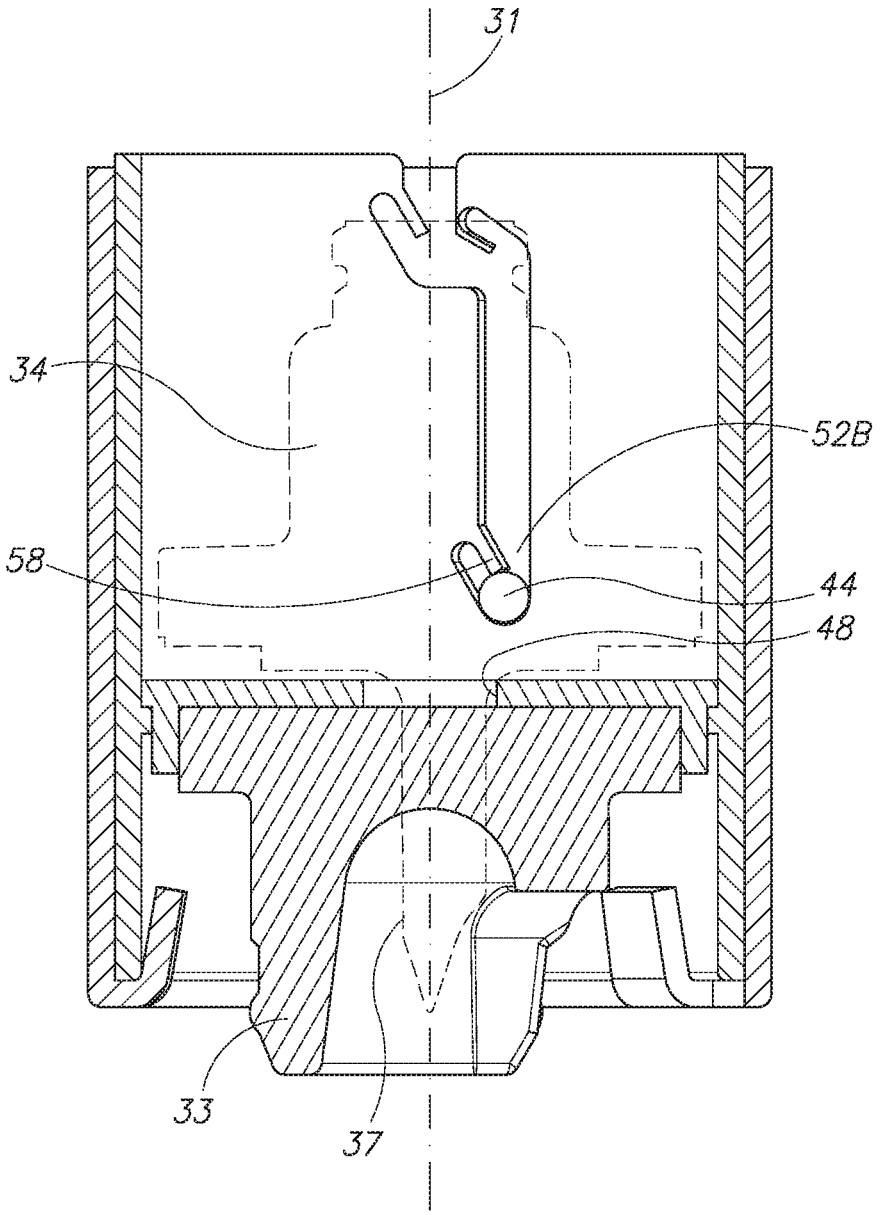
FIG. 13 is a longitudinal cross section of the FIG. 1 drug container closure in a final puncturing position.

FIG. 13 shows the fluid transfer member 34 in its activated position at the distal activation leg end pair 52B. This position is enabled by a user depressing the needleless syringe 10 towards the drug vial 20 until the outward directed pin pair 44 snap past the one-way activated snap member pair 58. The user hears a click as the outward directed pin pair 44 snap past the one-way activated snap member pair 58 indicating that he can proceed with drug reconstitution and administration. The one-way activated snap member pair 58 prevent the fluid transfer member 34 to be returned to an earlier position.

Figure 14A:
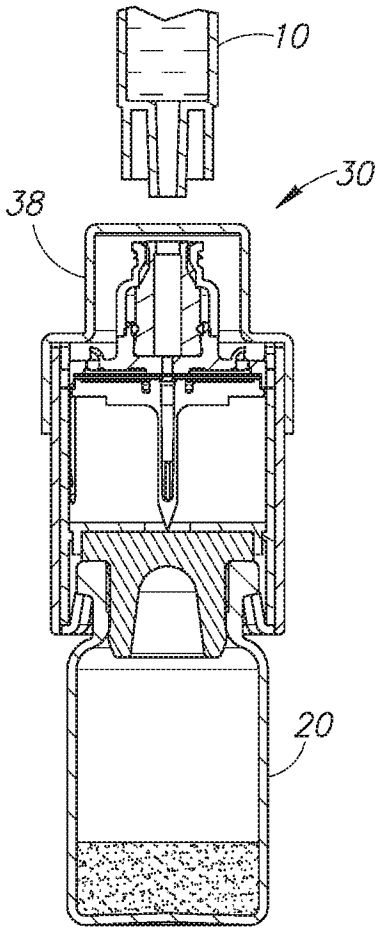
FIGS. 14A to 14C show the use of the FIG. 1 drug reconstitution assemblage.

The use of the drug reconstitution assemblage 100 is now described with reference to FIGS. 14A to 14C as follows:

FIG. 14A shows the drug reconstitution assemblage 100 in its set-up position before use as shown in FIG. 11. A user removes the closure cap 38 from the drug reconstitution assemblage 100 to expose the needleless syringe connector 36.

Figure 14B:
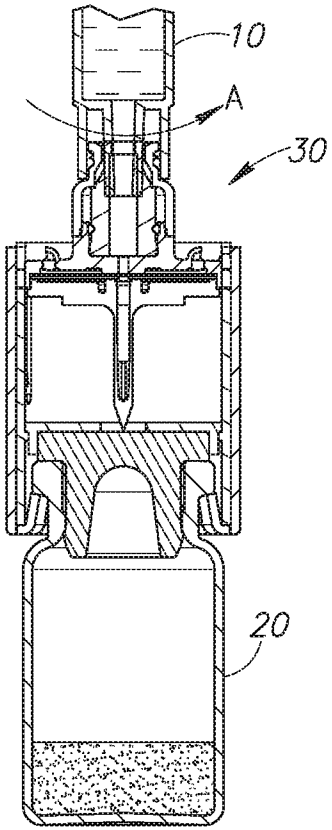

FIG. 14B shows the user screw threading the needleless syringe 10 onto the needleless syringe connector 36 in a clockwise direction denoted by arrow A to initially seal the syringe 10 thereon and subsequently urge the fluid transfer member 34 to stop at the proximal activation leg end pair 52A as shown in FIG. 12. The user hears a click as the fluid transfer member 34 passes the one-way primed snap member pair 56 to indicate the drug reconstitution assemblage 100 is primed for activation.

Figure 14C:
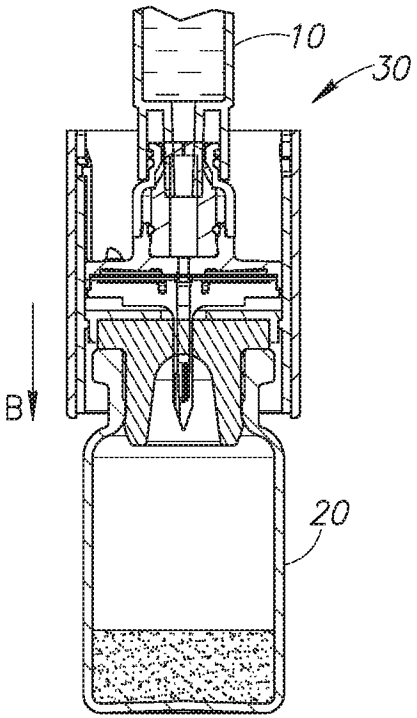

FIG. 14C shows the user pushes the fluid transfer member 34 downwards along the activation legs 52 as denoted by arrow B to stop at the distal activation leg pair end 52B as shown in FIG. 13. The displacement causes the puncturing cannula 37 to puncture through the drug container stopper 33. The user hears a click as the fluid transfer member 34 passes the one-way activated snap member pair 58 to indicate he can proceed with drug reconstitution and administration.

Figure 15:
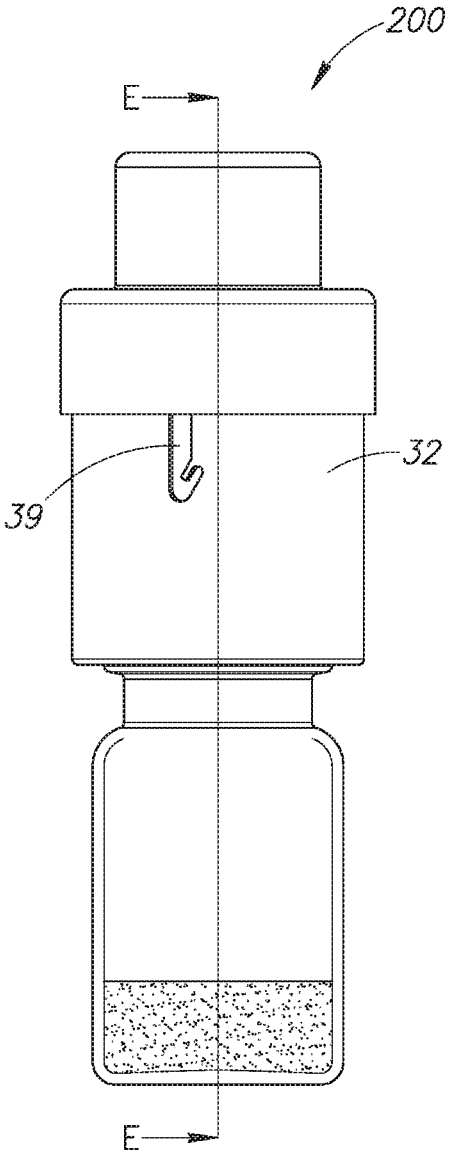
FIG. 15 is a front elevation view of a second embodiment of a drug reconstitution assemblage in accordance with the present invention in an initial non-puncturing position.
Figure 16:
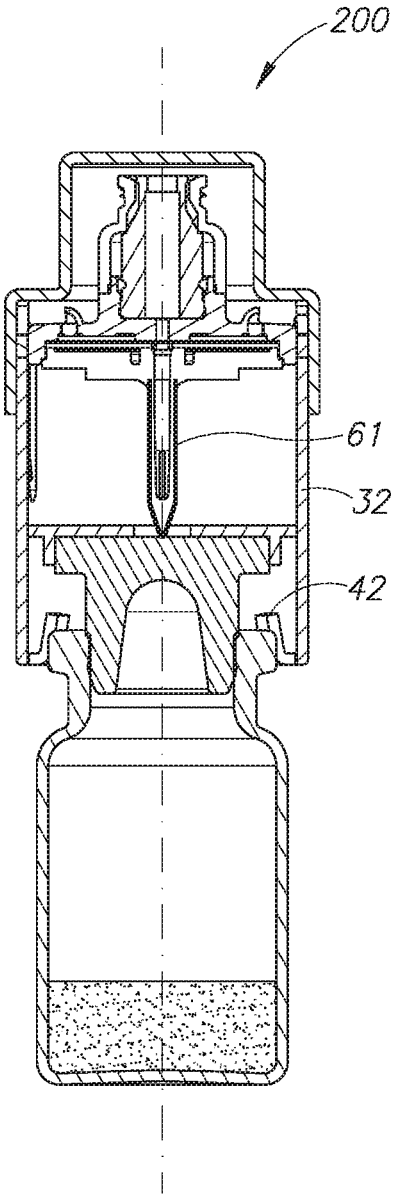
FIG. 16 is a longitudinal cross section of the FIG. 15 drug reconstitution assemblage along line E-E thereon.

FIGS. 15 and 16 show a ready-to-use drug reconstitution assemblage 200 similar in construction and operation as the ready-to-use drug reconstitution assemblage 100 and therefore similar parts are likewise numbered. The latter 200 differs from the former 100 insofar as the latter 200 does not have the sleeve 41 and therefore its closure housing 32 is formed with the snap fit members 42 and has a diametric open inverted L-shaped track pair 39. The latter 200 includes a sheath 61 placed on the puncturing cannula 37 for ensuring sterility. The sheath 61 tears and is urged upwards against the cross member underside 48B on downward displacement of the fluid transfer member 34 to its final puncturing position.

While the invention has been described with respect to a limited number of embodiments, it will be appreciated that many variations, modifications, and other applications of the invention can be made within the scope of the appended claims.

The invention claimed is:

1. A drug container closure for mounting on an open-topped drug container to form a ready-to-use drug reconstitution assemblage for use with a needleless syringe, the open-topped drug container having a drug container rim defining a drug container opening, the drug container closure having a longitudinal centerline and comprising:

(a) a tubular closure housing for securely mounting on the drug container rim, said closure housing including at least one inverted L-shaped track having an open-ended upright access leg, a horizontal priming leg and an upright activation leg, said activation leg having a proximal activation leg end and a distal activation leg end correspondingly adjacent and distal to said priming leg, each said inverted L-shaped track having:

i) an one-way retaining snap member between said open-ended upright access leg and said horizontal priming leg, ii) an one-way primed snap member between said horizontal priming leg and said proximal activation leg end, and iii) an one-way activated snap member towards said distal activation leg end;

(b) a drug container stopper securely mounted on said closure housing for sealing the drug container opening on securely mounting said closure housing on the drug container rim; and (c) a fluid transfer member having an integral needleless syringe connector and a puncturing cannula in flow communication therewith, said needleless syringe connector for attachment of the needleless syringe thereto, said puncturing cannula for puncturing said drug container stopper, said fluid transfer member being initially disposed along each said horizontal priming leg whereupon, on manual rotation of said fluid transfer member relative to said longitudinal centerline, said fluid transfer member is urged past each said one-way primed snap member to each said proximal activation leg end prior to being manually urged passed each said one-way activated snap member to each said distal activation leg end for puncturing said drug container stopper for flow communication with the drug container.

2. The closure according to claim 1 and further comprising a sleeve exterior to said closure housing for sealing each said inverted L-shaped track to ensure sterility of said puncturing cannula.

3. The closure according to claim 1 and further comprising a sheath on said puncturing cannula.

4. A ready-to-use drug reconstitution assemblage including an open-topped drug container and the drug container closure according to claim 1 mounted thereon.

5. A ready-to-use drug reconstitution assemblage including an open-topped drug container and the drug container closure according to claim 2 mounted thereon.

6. A ready-to-use drug reconstitution assemblage including an open-topped drug container and the drug container closure according to claim 3 mounted thereon.

* * * * *